US007592992B2

(12) United States Patent
Yi

(10) Patent No.: US 7,592,992 B2
(45) Date of Patent: Sep. 22, 2009

(54) INVERSION METHOD FOR LIQUID CRYSTAL DISPLAY

(75) Inventor: Chien-Yu Yi, Gueishan Township, Taoyuan County (TW)

(73) Assignee: Au Optronics Corp., Hsin-Chu (TW)

( * ) Notice: Subject to any disclaimer, the term of this patent is extended or adjusted under 35 U.S.C. 154(b) by 706 days.

(21) Appl. No.: 11/122,725

(22) Filed: May 5, 2005

(65) Prior Publication Data

US 2006/0164361 A1 Jul. 27, 2006

(30) Foreign Application Priority Data

Jan. 25, 2005 (TW) ..... 94102110 A

(51) Int. Cl.
*G09G 3/36* (2006.01)

(52) U.S. Cl. ..... 345/96; 345/58; 345/209

(58) Field of Classification Search ..... 345/96, 345/58, 209

See application file for complete search history.

(56) References Cited

U.S. PATENT DOCUMENTS 4,926,168 A * 5/1990 Yamamoto et al. ..... 345/58
6,400,350 B1 * 6/2002 Nishimura et al. ..... 345/96
2004/0178979 A1 * 9/2004 Watanabe et al. ..... 345/96
2004/0178980 A1 9/2004 Rao et al.
2004/0263454 A1 12/2004 Baek et al.

FOREIGN PATENT DOCUMENTS

| | | |
|---|---|---|
| CN | 1404028 | 3/2003 |
| CN | 1532794 | 9/2004 |
| CN | 1577462 | 2/2005 |
| TW | 594164 | 6/2004 |

OTHER PUBLICATIONS

CN Office Action mailed Mar. 9, 2007.
English Abstract of TW 594164.

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

An inversion method for use in a liquid crystal display having pluralities of pixels. First, at least one inversion signal is provided to determine a polarity. A data voltage is then generated according to the polarity and a data signal. Thereafter, a scan signal is provided to activate a pixel, such that the data voltage is converted to luminance. The inversion signal is a non-periodic signal. When the scan signal activates the pixel, the inversion signal provides the random alternative of a first level and a second level.

10 Claims, 7 Drawing Sheets

INVERSION METHOD FOR LIQUID CRYSTAL DISPLAY

BACKGROUND

The invention relates to liquid crystal display, and in particular, to an inversion method for liquid crystal display.

FIG. 1 shows a conventional liquid crystal display 100. Polarity inversion is a technique used in flat panel display to eliminate image retention caused by longtime DC biasing. The liquid crystal display 100 comprises a pixel array 102, a plurality of source drivers 104, and a plurality of gate drivers 106. The source driver 104 is driven by the timing controller 108 to output data signals, and the gate driver 106 outputs scan signals, thereby the pixel array 102 is driven to display images. Each of the source drivers controls a plurality of pixel columns, and each of the gate drivers controls a plurality of pixel lines, thus forming intersecting sections. The timing controller 108 provides inversion signals POL(1H) or POL (2H) to the source driver 104 for determining polarity of corresponding pixels. The source driver 104 thereafter generates data voltage of corresponding polarity accordingly to drive the pixels. The value of inversion signals varies with time, thus polarities of adjacent pixels are different. More specifically, polarities of adjacent pixels are at an opposite level. The inversion signal POL(2H) represents a period twice than that of inversion signal POL(1H). Symbols "+" and "–" denotes polarities of each section in one frame time. The polarity inversion, however, induces certain disadvantages. For example, when the image comprising a specific pattern is input, screen flicker occurs. The specific pattern is referred to as a Killer pattern, caused by panel resistance irregularity, and is unavoidable.

FIG. 2 is a timing chart of an inversion signal POL in the conventional liquid crystal display of FIG. 1. "GCK" denotes the scan line clock. The inversion signal POL(1H) periodically inverts every scan line, and the inversion signal POL (2H) every two scan lines. The inversion may resolve the Killer pattern of FIG. 1, however, another specific pattern can be found to induce screen flicker for the double period case. Thus periodic inversions always present a weakness.

SUMMARY

An embodiment of the invention provides an inversion method for use in a liquid crystal display comprising pluralities of pixels. First, at least one inversion signal is provided to determine a polarity. Data voltage is then generated according to the polarity and a data signal. Thereafter, a scan signal is provided to activate a pixel, such that the data voltage generates luminance. The inversion signal is a non-periodic signal. When the scan signal activates the pixel, the inversion signal provides the random alternative of a first level and a second level.

When the inversion signal is at the first level, the polarity is determined to be positive. When the inversion signal is at the second level, the polarity is determined to be negative. The first level is a logic 1, and the second level is a logic 0. The pixels are grouped by column, each group comprising at least one column, and the provision of at least one inversion signal comprises providing a plurality of inversion signals to individually determine the polarity of each group. The plurality of inversion signals comprises an odd inversion signal and an even inversion signal. The odd inversion signal determines polarity of odd groups, and the even inversion signal determine polarity of even groups.

Also provided is a liquid crystal display, comprising a timing controller, at least one source driver, and at least one gate driver. The timing controller generates a scan signal and a data signal, and provides at least one inversion signal to determine polarity of a data voltage. The source driver, coupled to the timing controller, generates the data voltage according to the inversion signal and the data signal. The gate driver, coupled to the timing controller, generates the scan signal to activate at least one pixel. When the scan signal activates the pixel, the pixel receives the data voltage for illumination. When the pixel is activated, the inversion signal has the random alternative of a first level and a second level. Wiring between the timing controller and the source drivers comprises point-to-point architecture.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

Figure 1:
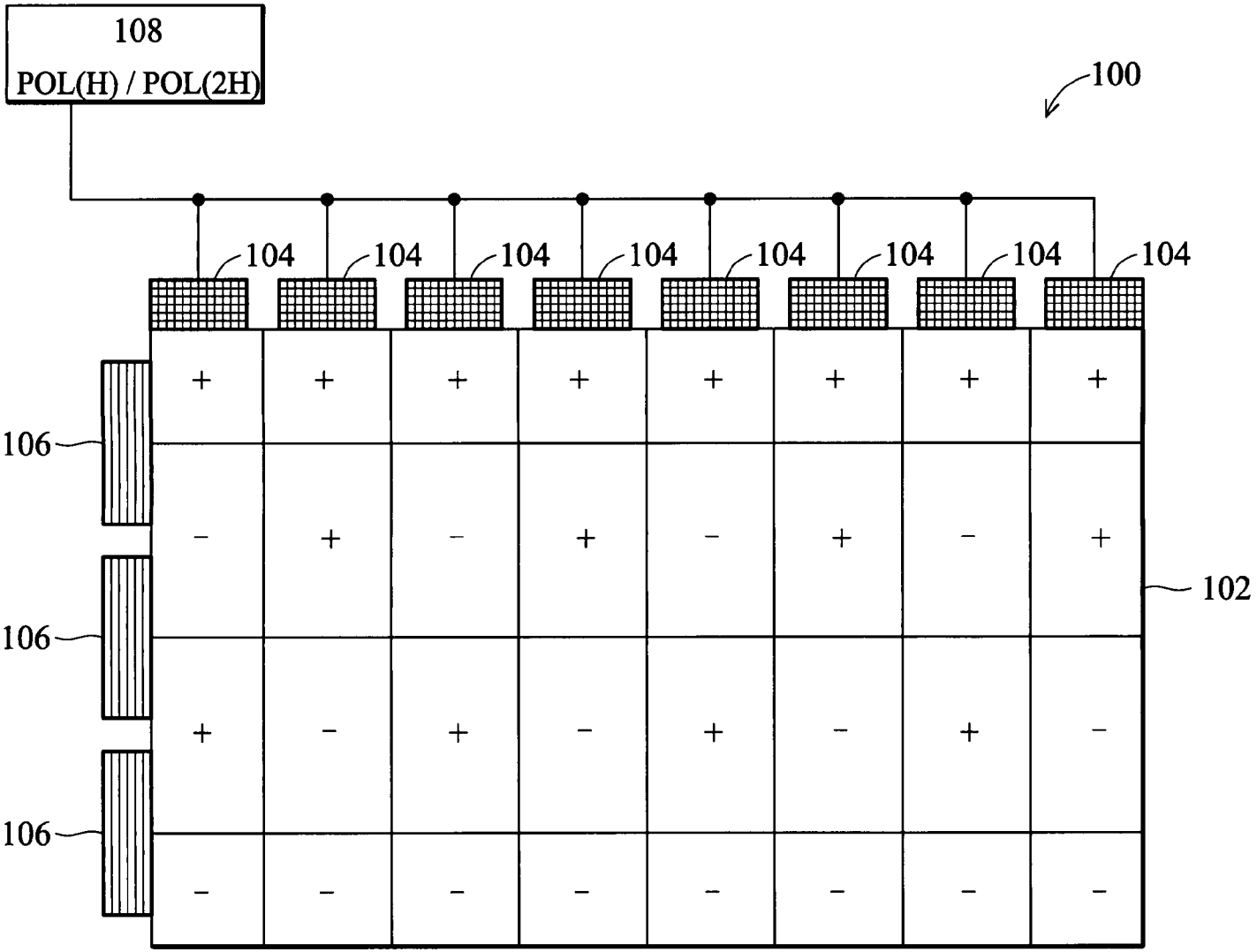
FIG. 1 shows a conventional liquid crystal display 100.
Figure 2:
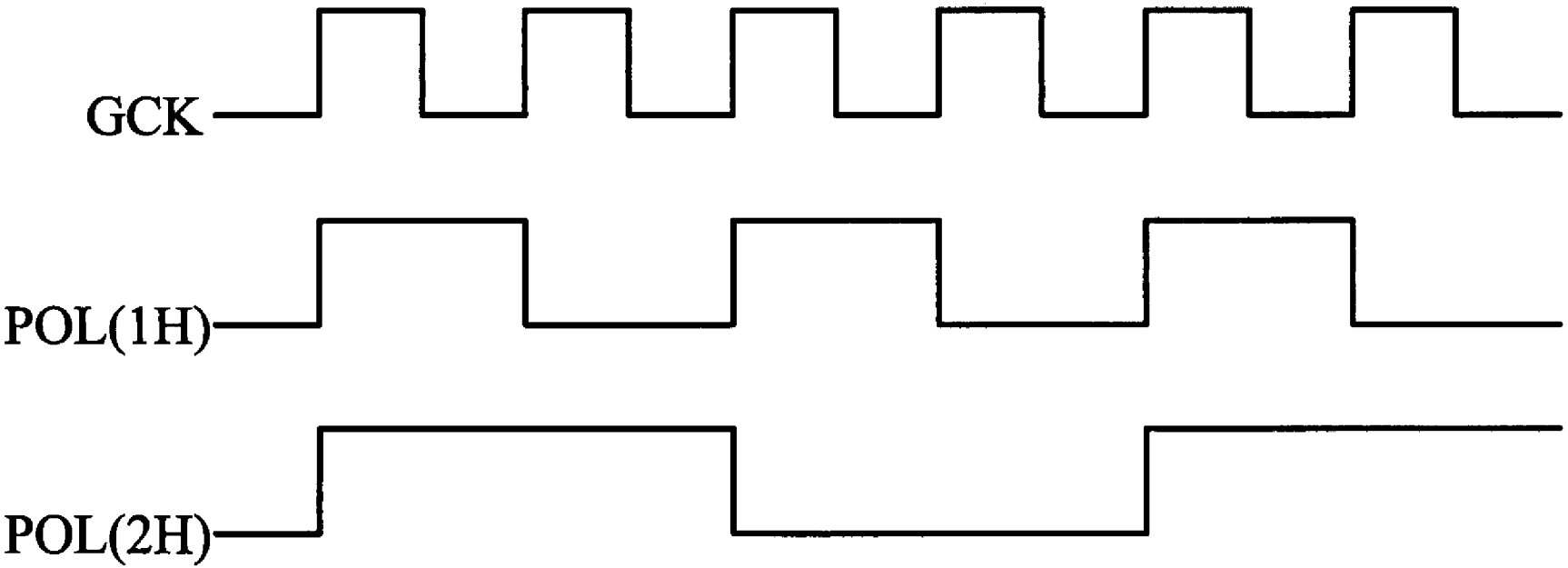
FIG. 2 is a timing chart of an inversion signal POL in the conventional liquid crystal display of FIG. 1.
Figure 3:
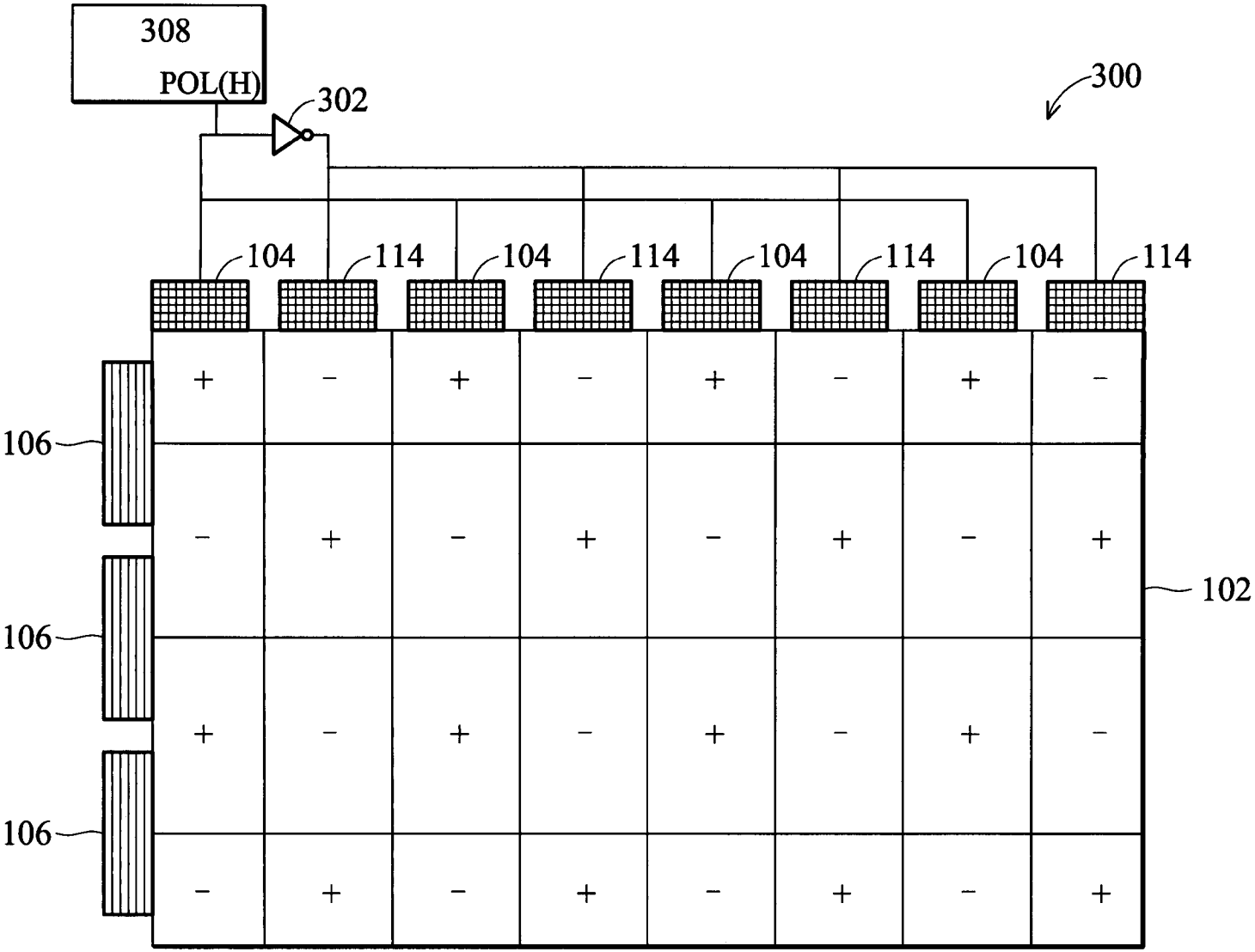
FIG. 3 shows an embodiment of a liquid crystal display liquid crystal display 300.

FIG. 3 is an embodiment of a liquid crystal display 300. The liquid crystal display 300 comprises a pixel array 102, three gate drivers 106 and four paired source drivers 104 and 114. The source driver 104 and 114 are identical chips arranged by order, even and odd, each drive corresponding to a plurality of column of pixels. Additionally, the liquid crystal display 300 comprises a timing controller 308 for generating an inversion signal POL, wherein the inversion signal is a non-periodic random signal, comprising random alternatives of logic 0 and logic 1. Through an inverter 302, the source drivers 104 and 114 receive the inversion signal POL with opposite polarity, such that the corresponding plurality of pixel columns is driven to eliminate the killer pattern effect.

Figure 4:
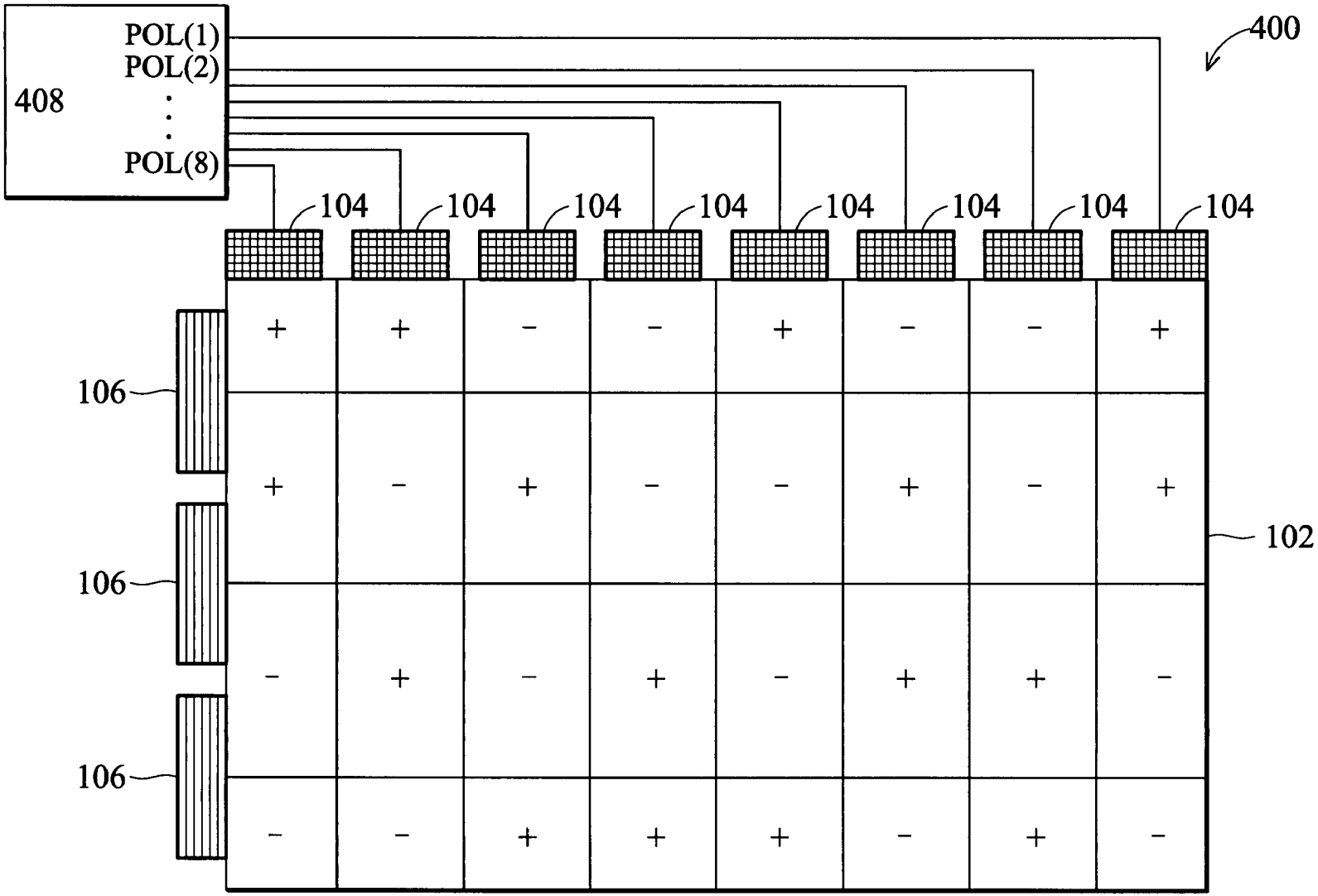
FIG. 4 shows an embodiment of a liquid crystal display liquid crystal display 400.

FIG. 4 shows an embodiment of a liquid crystal display 400. The liquid crystal display 400 comprises a pixel array 102, three gate drivers 106 and eight source drivers 104. Each source driver 104 drives corresponding plurality column of pixels. Additionally, the liquid crystal display 400 comprises a timing controller 408, generating eight different inversion signals POL to corresponding source driver 104, such that the corresponding plurality column of pixels are driven with individual random inversion. During display, the timing controller 408 delivers a scan signal and a data signal to the gate driver 106 and source driver 104. The source driver 104, coupled to the timing controller 408, generates data voltage based on the received inversion signal POL and the data signal, to drive a pixel. The polarity of the data voltage is determined by the inversion signal POL. When the gate driver 106 outputs the scan signal to activate the corresponding pixel in the pixel array 102, the pixel converts the data voltage to luminance.

Figure 5:
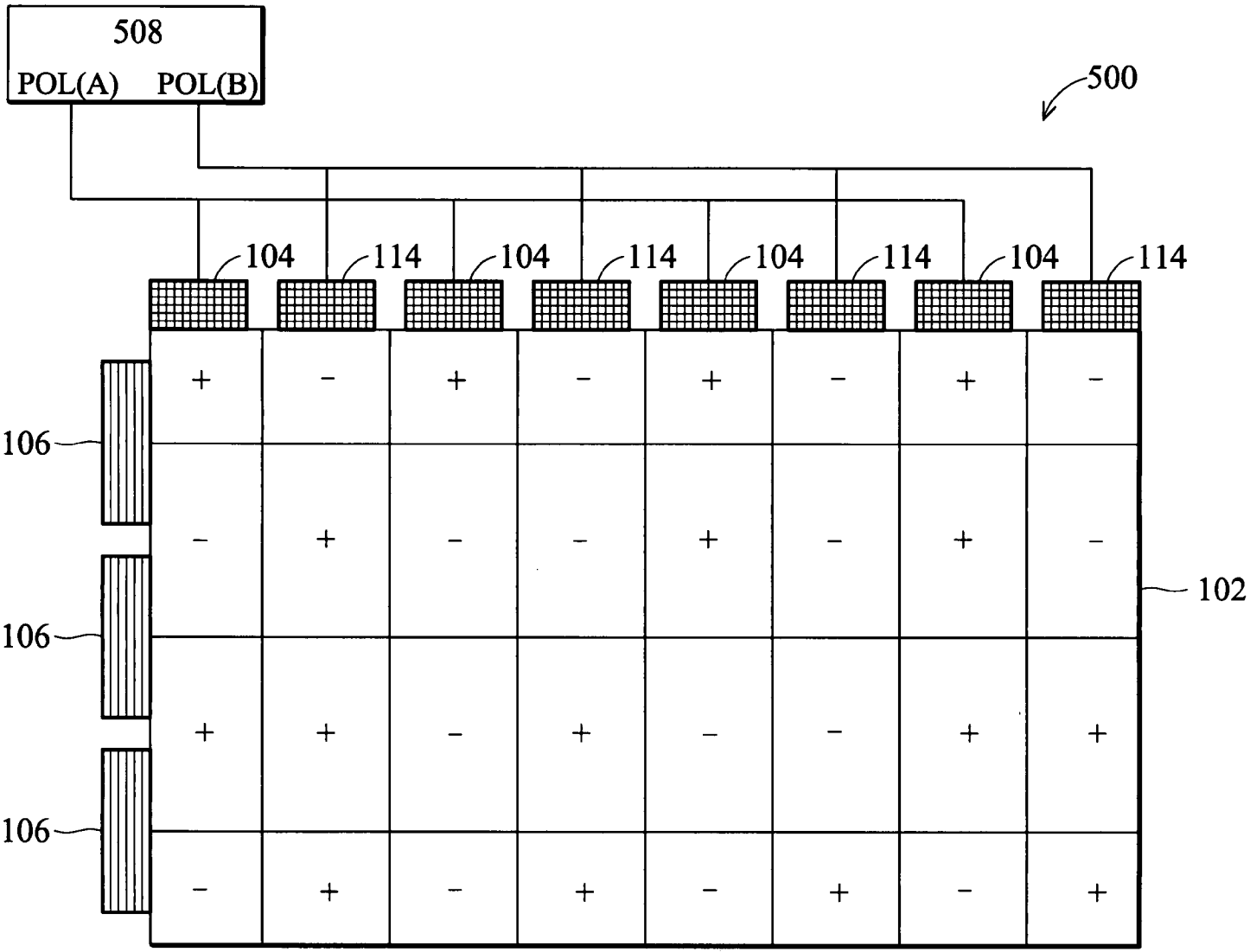
FIG. 5 shows an embodiment of a liquid crystal display liquid crystal display 500.
Figure 7:
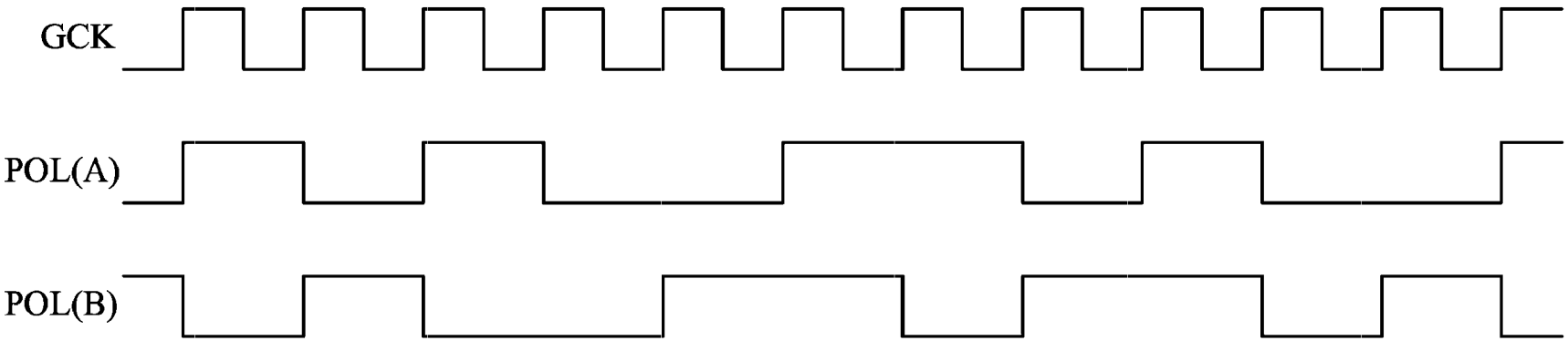
FIG. 7 is a timing chart similar to FIG. 2, illustrating features or aspects of the embodiment shown and described in connection with FIG. 5.

FIG. 5 shows an embodiment of a liquid crystal display 500. The liquid crystal display 500 comprises a plurality of source drivers 104 and 114, arranged by order, even and odd, each coupled to the timing controller 508. The source drivers 104 and 114 receive different inversion signals. Specifically, the four source drivers 104 are driven by an inversion signal POL(A), and the four source drivers 114 are driven by an inversion signal POL(B). The inversion signal POL(A) and the inversion signal POL(B) may have no relationship, and may be of opposite polarity. Both are non-periodic random signals comprising random alternatives of logic 0 and logic 1, as shown in FIG. 7. Random signal generation is achieved by conventional pseudo-random algorithm. The output comprises only two values, logic 0 and logic 1, with equal probability. The eight different inversion signals POL in FIG. 4, may be generated by one circuit with eight different random seeds. The inversion is non-periodic, such that flicker never occurs. The timing controller may further avoid flicker by predicting the killer pattern based on the image data, and enhance the image accordingly through specific inversion. The gate driver 106 scans the pixel array 102 line by line, and the source driver 104 inverts the activated pixels according to the inversion signals POL output from the timing controller.

Figure 6:
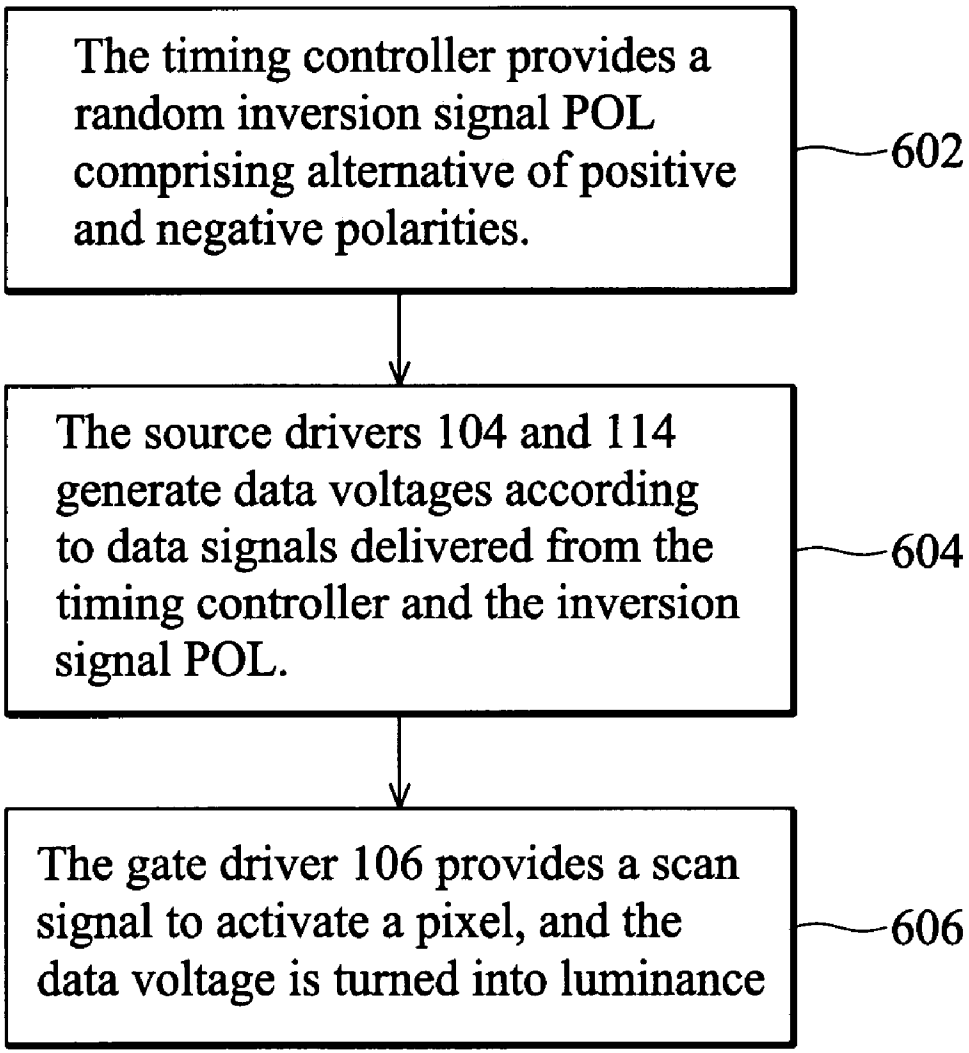
FIG. 6 is a flowchart of the inversion method according to the invention.

FIG. 6 is a flowchart of the inversion method according to the invention. In step 602, the timing controller provides a random inversion signal POL comprising random alternative of positive and negative polarities. In step 604, the source drivers 104 and 114 generate data voltages according to data signals delivered from the timing controller and the inversion signal POL. In step 606, the gate driver 106 provides a scan signal to activate a pixel, and the data voltage generates luminance. The random inversion avoids flicker.

The inversion signal may require additional wiring in conventional architecture, thus the invention is more suitable for point-to-point architecture that utilizes a serial data stream to transfer the signals between the timing controller and the source drivers without the need for additional wiring.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inversion method for use in a liquid crystal display comprising pluralities of pixels, comprising:

dividing the plurality of pixels by columns into a plurality of groups comprising first groups and second groups;

providing a first inversion signal and a second inversion signal to respectively determine polarities of first group pixels and second group pixels, wherein the first and second inversion signals are different non-periodic signals, and each of the first inversion signal and the second signal is a non-periodic signal with an individually random alternative of a first level and a second level;

generating first data voltages for the first group pixels according to the first inversion signal and data signals corresponding to each of the first group pixels;

generating second data voltages for the second group pixels according to the second inversion signal and data signals corresponding to each of the second group pixels; and providing a scan signal to scan the pixels, such that the first data voltages and second data voltages are converted to illuminate corresponding pixels.

2. The inversion method as claimed in claim 1, further comprising:

when the first inversion signal or the second inversion signal is at the first level, determining the a corresponding polarity to be positive; and when the first inversion signal or the second inversion signal is at the second level, determining the corresponding polarity to be negative.

3. The inversion method as claimed in claim 2, wherein:

the first level is a logic 1; and the second level is a logic 0.

4. The inversion method as claimed in claim 3, wherein the first groups are odd groups and the second groups are even groups.

5. A liquid crystal display including a plurality of pixels, the plurality of pixels being divided by columns into a plurality of groups comprising first groups and second groups, comprising:

a timing controller, providing a first inversion signal and a second inversion signal to respectively determine polarities of first group pixels and second group pixels, wherein the first inversion signal and the second inversion signal are different non-periodic signals, and each of the first inversion signal and the second signal is a non-periodic signal with an individually random alternative of a first level and a second level;

at least one first source driver, coupled to the timing controller, generating first data voltages for the first group pixels according to the first inversion signal and data signals corresponding to each of the first group pixels;

at least one second source driver, coupled to the timing controller, generating second data voltages for the second group pixels according to the second inversion signal and data signals corresponding to each of the second group pixels;

at least one gate driver, coupled to the timing controller, generating a scan signal to scan the pixels, such that the first data voltages and second data voltages are converted to illuminate corresponding pixels.

6. The liquid crystal display as claimed in claim 5, wherein:

when the first inversion signal or the second inversion signal is at the first level, a corresponding polarity is set of positive; and when the first inversion signal or the second inversion signal is at the second level, the corresponding polarity is set of negative.

7. The liquid crystal display as claimed in claim 6, wherein:

the first level is a logic 1; and the second level is a logic 0.

8. The liquid crystal display as claimed in claim 5, wherein:

the at least one of the first source driver or the second source driver comprises a plurality of source drivers, each driving at least one column; and the timing controller provides individual inversion signals to each of the source drivers.

9. The liquid crystal display as claimed in claim 8, wherein the first groups are odd groups and the second groups are even groups.

10. The liquid crystal display as claimed in claim 5, wherein:

the wiring between the timing controller and the first source driver or the second source drivers comprises point-to-point architecture.

* * * * *